United States Patent [19]

Farr

[11] 4,414,518

[45] Nov. 8, 1983

[54] VERTICAL DESCENT RATE DETECTOR SWITCH

[75] Inventor: Aaron V. Farr, Logan, Utah

[73] Assignee: Abex Corporation, New York, N.Y.

[21] Appl. No.: 445,815

[22] Filed: Nov. 30, 1982

Related U.S. Application Data

[63] Continuation of Ser. No. 197,395, Oct. 16, 1980.

[51] Int. Cl.[3] ..... H01H 9/00

[52] U.S. Cl. ..... 335/205; 335/207

[58] Field of Search ..... 335/205, 206, 207; 200/84 C

[56] References Cited

U.S. PATENT DOCUMENTS 3,732,512 5/1973 Puttick ..... 335/207 X

*Primary Examiner*—George Harris

*Attorney, Agent, or Firm*—Thomas S. Baker, Jr.; David A. Greenlee

[57] ABSTRACT

A vertical descent rate detector switch has a pair of contacts which are magnetically actuated when the rate of vertical descent of the switch exceeds a set amount.

1 Claim, 6 Drawing Figures

VERTICAL DESCENT RATE DETECTOR SWITCH

CROSS REFERENCE TO RELATED APPLICATIONS

This application is a continuation of application Ser. No. 06/197,395, filed Oct. 16, 1980.

BACKGROUND OF THE INVENTION

This invention relates to a switch which is actuated when it senses a rate of descent which exceeds a set amount.

The switch of the instant invention is used to detect when the device to which it is attached is descending vertically at or above a set rate. An example of where a vertical descent rate detector switch can be employed is in an emergency brake control system for an aircraft passenger loading bridge. The distal end of such a bridge is raised or lowered in order to properly position a cab at the end of the bridge with respect to the door of an aircraft. If, in the event of an emergency, the distal end of the bridge descends too rapidly, the brake control system applies a brake on the bridge drive mechanism to slow the descent of the bridge. The rate detector switch of the instant invention actuates the control system to apply the brake when it senses a rate of descent of the bridge in excess of a set amount.

When attempting to use a commercially available switch in the brake control system of a passenger loading bridge, it was found that the switch was actuated and the brake applied when the bridge was moved horizontally as well as when it was moved vertically. This adversely affected the ability of an operator to move the bridge horizontally to engage an aircraft. Consequently, it was necessary to develop a switch which detected and was actuated when it sensed a vertical rate of descent which equalled or exceeded a set amount but was relatively insensitive to horizontal forces. It was also necessary to make a switch which did not require an external power supply or other circuitry.

SUMMARY OF THE INVENTION

The instant invention provides a vertical descent rate detector switch having a pair of contacts which are actuated when the rate of vertical descent of the switch exceeds a set amount. The rate detector switch includes a first magnet mounted at one end of a non-magnetic guide. The guide passes through a bore in a second magnet which is positioned above the first magnet such that the lines of the magnetic field of the first magnet are opposite in direction to the lines of the magnetic field of the second magnet, and the second magnet is suspended above the first magnet by the opposing magnetic fields. The contacts of the switch are mounted in the guide between the first and second magnets. The second magnet is movable with respect to the first magnet between a first position in which the lines of the magnetic fields of the first and second magnets pass through the first and second contacts, respectively, such that the contacts have the same polarity and the contacts are opened, and a second position in which the lines of the magnetic fields of one of the first and second magnets pass through the first and second contacts such that the contacts have opposite polarity and the contacts are closed. The second magnet is in one of the first or second positions when the switch senses a rate of descent which is below a set amount and is in the other of the first and second positions when the switch senses a rate of descent which exceeds a set amount.

DESCRIPTION OF THE PREFERRED EMBODIMENT

Figure 1:
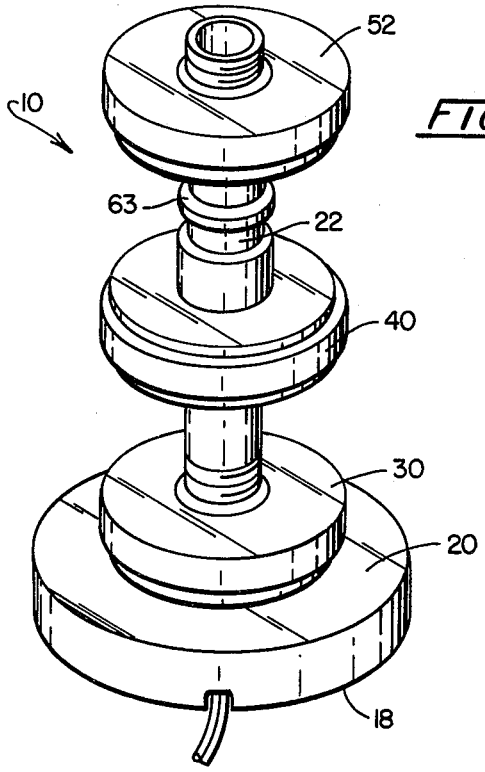
FIG. 1 is a perspective view of the vertical descent rate detector switch of the instant invention.
Figure 2:
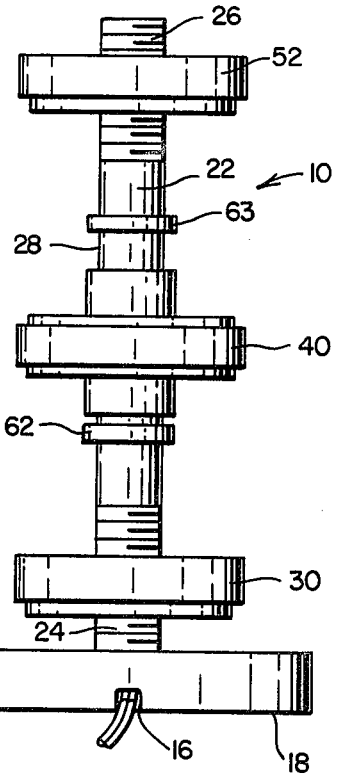
FIG. 2 is a side view of the instant switch.
Figure 3:
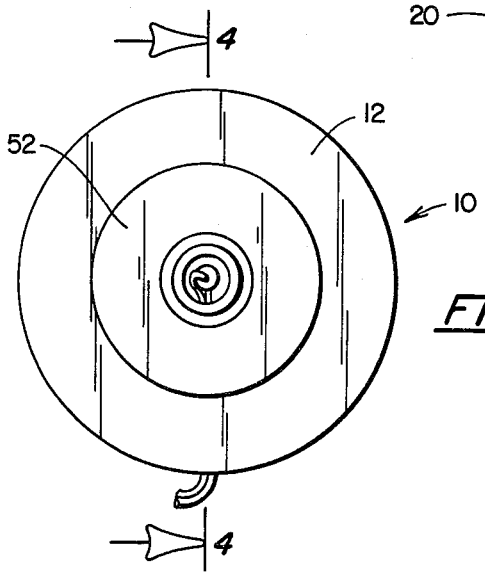
FIG. 3 is a top view of the instant switch.

Referring to FIGS. 1–3 of the drawings, the vertical descent rate detector switch 10 of the instant invention has a cylindrical base 12 which has a threaded axial bore 14 and a lateral slot 16 formed in the bottom surface 18 which extends radially outward from the bore 14 to the side 20. A hollow shaft 22, which is threaded at each end 24, 26, is vertically mounted on base 12 by having end 24 threaded into bore 14. Shaft 22 is constructed of a non-ferrous material, such as stainless steel, aluminum or plastic, and has a smooth, central, exterior surface 28.

A first cylindrical ceramic magnet 30, which has a central bore 2, is mounted on a shoulder 34 of a cylindrical support 36 which is constructed from a non-ferrous material. Support 36 has a threaded bore 38 and is threaded onto the end 24 of shaft 22 adjacent base 12 to thereby fix the magnet 30 to one end of the shaft 22. A second cylindrical ceramic magnet 40, which has a central bore 42, is mounted in a holder 44 which has a smooth axial bore 46 and is constructed from a non-ferrous material. A bearing 48, which is constructed of a non-ferrous material, such as plastic, glass or Teflon ®, and has a smooth central bore 50, is pressed into bore 46. The outside diameter of shaft 22 is slightly less than the diameter of bore 50 and shaft 22 projects through the bore 50 of bearing 48 in holder 44. Magnet 40 can move parallel with respect to shaft 22 but cannot move sideways relative to shaft 22. Holder 44 is oriented such that the bottom surface of magnet 40 has the same polarity as the top surface of magnet 30. Since the polarity of the top and bottom surfaces of the magnets 30, 40 is the same, the lines of force of the magnetic fields of the two magnets 30, 40 run in opposite directions, the magnets 30, 40 repel each other and the movable magnet 40 is suspended above the fixed magnet 30. A third cylindrical ceramic magnet 52, having a central bore 54, is mounted on a shoulder 56 of a cylindrical support 58. Cylindrical support 58 has a threaded bore 60 which is threaded onto the top end 26 of shaft 22 to thereby affix the magnet to one end 26 of the shaft 22. Magnet 52 is mounted such that the polarity of the bottom surface of the magnet 52 is opposite to the polarity of the top surface of the movable magnet 40.

A stop 62 is mounted on shaft 22 to prevent downward movement of the magnet 40, and a stop 63 is mounted on shaft 22 approximately one-quarter inch above magnet 40 to prevent magnet 40 from moving out of its operate/non-operate region, as described hereinafter.

Figure 4:
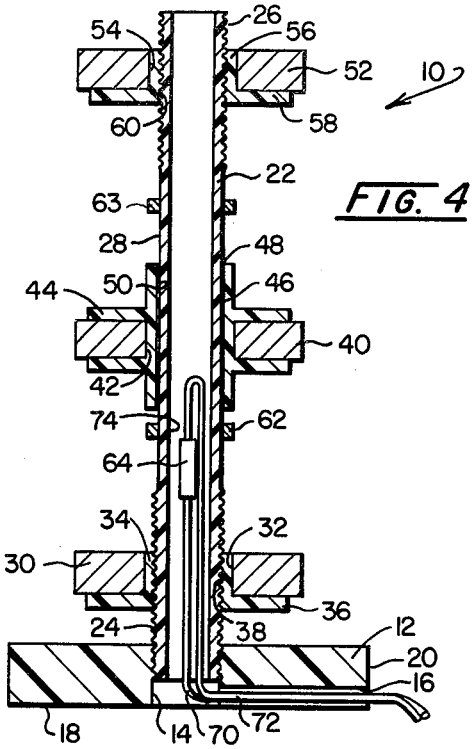
FIG. 4 is a view along line 4—4 of FIG. 3.
Figure 5:
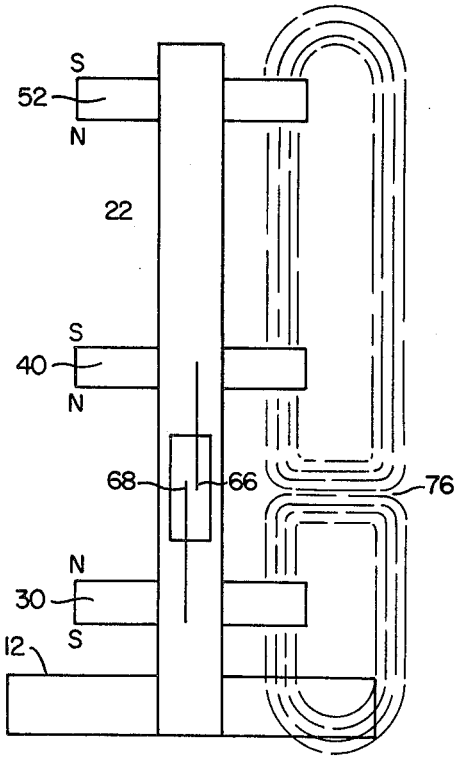
FIG. 5 is a view of the instant switch showing the lines of the magnetic fields of the magnets when the switch contacts are opened.
Figure 6:
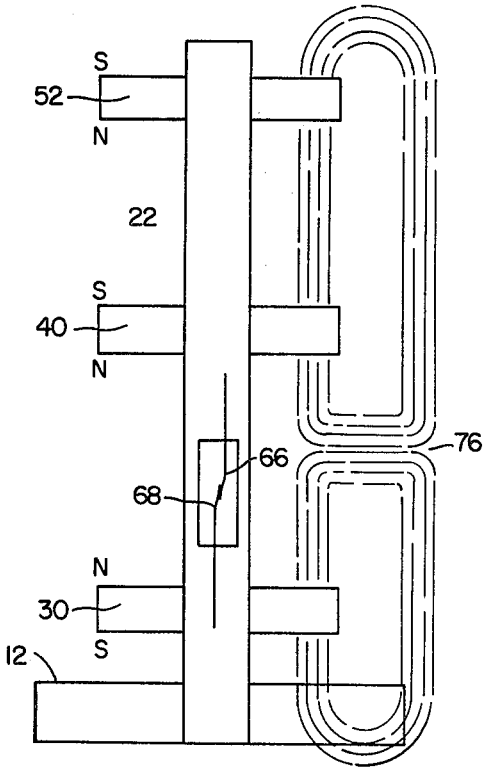
FIG. 6 is a view of the instant switch showing the lines of the magnetic fields of the magnets when the switch contacts are closed.

Referring to FIGS. 4–6, a reed switch 64 having a pair of contacts 66, 68 surrounded by an inert gas and enclosed in a sealed glass envelope, is mounted in a central bore 74 of shaft 22, such that the contacts 66, 68 are positioned between the stationary magnet 30 and the movable magnet 40. The contacts 66, 68 are connected to wires 70, 72, respectively, which are connected to a circuit which functions when the switch 10 is actuated.

Operation of the rate detector switch 10 is as follows. Referring to FIG. 5, when the device to which the switch 10 is attached, such as an aircraft passenger loading bridge, is at rest, the movable magnet 40 is suspended above the stationary magnet 30 by the opposing lines of force of the magnetic fields of the magnets 40, 30. The weight of the movable magnet 40 is zero, since its weight is cancelled by the repulsion of the magnetic fields. Although its weight is zero, the mass of magnet 40 is several ounces and inertial forces act on this mass as described below.

In the area 76 between the magnetic fields of the stationary magnet 30 and movable magnet 40, there is a magnetic void. In the magnetic void area 76 the lines of force of the magnetic fields run perpendicular to the axis of the shaft 22. If the reed switch 64 is positioned within bore 74 of the shaft 22 such that the area where the switch contacts 66, 68 come together is adjacent the area 76 of the magnetic void, the switch contacts will remain open. The reason for this is that the lines of the field of the stationary magnet 30 pass through one contact 68 and the lines of force of the magnetic field of movable magnet 40 pass through the other contact 66. Since the lines of force of the two fields run in opposite directions with respect to each other, the contacts 66, 68 have the same polarity which causes the contacts to repel each other and remain open.

When the device to which the rate detector switch 10 is attached descends vertically at or above a set rate, the reed switch contacts 66, 68 are closed as shown in FIG. 6. As previously mentioned, the weight of the movable magnet 40 is zero since its weight is cancelled by the repelling force of the magnetic fields of the stationary and movable magnets 30, 40, respectively. The mass of magnet 52 is on the order of a few ounces. When the rate of descent of the device exceeds a set amount, the movable magnet 40 tends to move up shaft 22 towards the third magnet 52. As the movable magnet 40 moves upward the magnetic void area 76 also moves up. When this happens, the contacts 66, 68 of the switch 64 close. They close because the lines of force of the magnetic field of the first magnet 30 flow through both contacts 66, 68 which causes the contacts to have opposite polarity and hence be attracted to each other. In this case, the lines of force of the field of the first magnet 30 are running generally parallel to the contacts 66, 68.

When the switch 10 is stationary, the position of the magnetic void area 76 can be changed such that the area 76 is directly opposite the switch contacts 66, 68 by rotating stationary magnet 30 on the threaded portion 24 of shaft 22 until the contacts 66, 68 are open with respect to each other.

Since, as mentioned above, the stationary magnet 52 is positioned above the movable magnet 40 such that its magnetic field runs in the same direction as that of the movable magnet 40, the movable magnet 40 is somewhat attracted to it. The function of the third magnet 52 is to linearize the movement of the movable magnet 40. As magnet 40 moves up the shaft 22, the repulsive force between the opposing field of the stationary magnet 30 and the movable magnet 40 tends to weaken. The loss of this repulsive force is made up by the increase in the attractive force between the magnetic fields of the movable magnet 40 and the stationary magnet 52.

The process of calibrating the switch 10, i.e., setting it to operate in response to different rates of vertical descent, is as follows. When shaft 22 is in the vertical position, the entire weight of movable magnet 40 is supported by the repelling force of the magnetic fields of the stationary and movable magnets 30, 40, respectively. When the rate detector switch 10 is at rest, the gravity force acting on the movable magnet 40 is 1.0. When a body is in a state of free-fall, the force of gravity acting on the body is zero. In order for the movable magnet 40 to move upward with respect to the shaft 22, it must be subjected to a gravity force of less than 1.0. The instant rate detector switch 10 is designed to sense a rate of descent having a force of gravity, or "G" force, between zero and 1.0.

On the aforementioned aircraft passenger loading bridge it was found desirable to set the switch 10 to actuate when it senses a rate of descent having a gravity, or "G" force, approximately equal to 0.9.

It was found that when the switch 10 is moved off the vertical, the movable magnet 40 starts to move up the shaft 22. This occurs because a portion of the weight of the magnet 40 is taken by the shaft 22 and the repelling force between the fields of the stationary and movable magnets 30, 40, respectively, can further move the two magnets 30, 40 apart. As the magnet 40 moves up the shaft 22, the area 76 of the magnetic void is changed. The position in the central bore of shaft 22 in which the contacts 66, 68 are actuated can be found in the following manner. The switch 10 is tilted so that the axis of shaft 22 is tilted from the vertical at an angle whose cosine is equal to the gravity force at which it is desired to have the switch 10 actuate. While the switch 10 is at this angle, the reed switch 64 is inserted in the central bore 74 of shaft 22 until the switch is actuated. When the reed switch is properly positioned, it is secured by means of pouring a potting material, such as an epoxy or silicon rubber, into the bore 74. After the material has hardened, the switch 10 is placed in a vertical position. The cylindrical support 36 for the stationary magnet 30 is moved until the area 76 of the magnetic void is properly positioned with respect to the contacts 66, 68, stop 62 is moved adjacent the bottom of movable magnet 40 and stop 63 is positioned approximately one-quarter inch above magnet 40 to prevent the magnet 40 from moving out of the operate/non-operate region.

Although a preferred embodiment of the invention has been illustrated and described, it will be apparent to those skilled in the art that various modifications may be made without departing from the spirit and scope of the present invention.

I claim:

1. A vertical descent rate detector switch actuated when force of gravity acting thereon is less than 1.0 comprising:

a non-magnetic means for guiding a magnet;

a first magnet mounted at one end of the guide means;

a movable second magnet;

a bore formed in the second magnet characterized by;

the guide means passing through the bore in the second magnet such that the second magnet is positioned above the first magnet; the first and second magnets positioned such that the lines of the magnetic field of the first magnet run opposite in direction to the lines of the magnetic field of the second magnet to cause the first and second magnets to repel each other and the second magnet is supported above the first magnet by the opposing magnetic fields such that the weight of the second magnet is cancelled;

first an second contacts positioned in the guide means between the first and second magnets;

the contacts being movable between a first position in which they are opened and a second position in which they are closed; the second magnet being movable between a first position in which the lines of the magnetic fields of the first and second magnets pass through the first and second contacts respectively such that the contacts have the same polarity and are opened and a second position in which the lines of the magnetic fields of one of the first and second magnets pass through the first and second contacts such that the contacts have opposite polarity and are closed; the second magnet is in one of the first or second positions when the switch is at rest and the gravity force acting on the switch and the first magnet is equal to 1.0; and the second magnet is in the other of the first or second positions when the rate of descent of the switch and the first magnet is equal to a gravity force of less than 1.0 and the relative distance between the first and second magnets is greater than when the switch is at rest.

* * * * *